US012022968B2

(12) United States Patent
Meddah

(10) Patent No.: US 12,022,968 B2
(45) Date of Patent: Jul. 2, 2024

(54) APPARATUS AND METHOD FOR SECURING DELIVERED PACKAGES

(71) Applicant: Ismail Meddah, Villefranche (FR)

(72) Inventor: Ismail Meddah, Villefranche (FR)

( * ) Notice: Subject to any disclaimer, the term of this patent is extended or adjusted under 35 U.S.C. 154(b) by 144 days.

(21) Appl. No.: 17/852,160

(22) Filed: Jun. 28, 2022

(65) Prior Publication Data

US 2023/0414025 A1 Dec. 28, 2023

(51) Int. Cl.
*A47G 29/14* (2006.01)
*A47G 29/20* (2006.01)
*A47G 29/22* (2006.01)

(52) U.S. Cl.
CPC ..... *A47G 29/141* (2013.01); *A47G 29/20* (2013.01); *A47G 29/22* (2013.01); *A47G 2029/144* (2013.01); *A47G 2029/145* (2013.01)

(58) Field of Classification Search
CPC ..... A47G 29/141; A47G 29/20; A47G 29/22; A47G 2029/144; A47G 2029/145; B65D 7/26; B65D 9/14; B65D 15/24; B65D 21/086
See application file for complete search history.

(56) References Cited

U.S. PATENT DOCUMENTS 2,456,479 A * 12/1948 Antil ..... B65D 9/14 312/258
10,321,780 B1 * 6/2019 James ..... A47G 29/141
10,537,196 B1 * 1/2020 MacPherson ..... A47G 29/141
10,696,453 B2 * 6/2020 Sena ..... A47G 29/141
10,709,276 B2 * 7/2020 Guanch ..... A47G 29/20
10,743,694 B2 * 8/2020 Raphael ..... A47G 29/141
11,109,705 B2 * 9/2021 Raphael ..... A47G 29/141
11,246,443 B2 * 2/2022 Lin ..... A47G 29/141
11,510,517 B2 * 11/2022 McLean ..... B65D 11/1853
11,751,708 B2 * 9/2023 Wu ..... A47G 29/141 232/19
2017/0127868 A1 * 5/2017 Adewuyi ..... A47G 29/22
2018/0296016 A1 * 10/2018 Teoh ..... A47G 29/20
2019/0225375 A1 * 7/2019 Sena ..... A47G 29/20
2019/0320836 A1 * 10/2019 Guanch ..... A47G 29/20
2019/0350398 A1 * 11/2019 Raphael ..... A47G 29/141
(Continued)

FOREIGN PATENT DOCUMENTS

DE 102014209510 B3 * 6/2015 ..... A47G 29/20
WO WO-2017014521 A1 * 1/2017 ..... A47G 29/14

*Primary Examiner* — William L Miller
(74) *Attorney, Agent, or Firm* — Mohr Intellectual Property Law Solutions, P.C.

(57) ABSTRACT

A system for securing packages has a support pole secured proximate to a hinged side of a door; a frame secured to the support pole; a securing means secured to the door frame and to the door; and a package box that is secured to the frame and that receives a delivered package. The package box is defined by a front panel, a bottom panel rotatably secured to the front panel, a lid panel rotatably secured to the frame, and a first and second plurality of side members rotatably secured to the frame and the front panel. When the package box is in a folded position, the front panel, the bottom panel, and the lid panel are oriented vertically and are proximate to the frame. When the package box is opened, the front panel extends outwardly in a vertical orientation and the bottom panel rotates downwardly to a horizontal orientation.

14 Claims, 9 Drawing Sheets

(56) References Cited

U.S. PATENT DOCUMENTS

| | | | | |
|---|---|---|---|---|
| 2020/0107663 | A1* | 4/2020 | Eivaz | A47G 29/141 |
| 2020/0383508 | A1* | 12/2020 | Arif | A47G 29/20 |
| 2021/0127880 | A1* | 5/2021 | Raphael | A47G 29/141 |
| 2021/0228013 | A1* | 7/2021 | Zhang | A47G 29/20 |
| 2021/0355741 | A1* | 11/2021 | Chiappetta | A47G 29/141 |
| 2021/0361104 | A1* | 11/2021 | McLean | B65D 15/24 |
| 2022/0257041 | A1* | 8/2022 | Redford | B65D 11/186 |
| 2022/0267048 | A1* | 8/2022 | Rogers | B65D 7/26 |
| 2022/0346583 | A1* | 11/2022 | Evangelidis | A47G 29/20 |
| 2022/0395124 | A1* | 12/2022 | Meddah | G08B 3/10 |

* cited by examiner

APPARATUS AND METHOD FOR SECURING DELIVERED PACKAGES

BACKGROUND OF THE INVENTION

Home delivery of packages is becoming increasingly common. For example, consumers are able to make online purchases of a product via the Internet. Such packages, when delivered, are often left outside of a home or building where the package is delivered to. Here, it is assumed that a person inside the home or building will come to the door and take the delivered package inside so that the package is secure.

Unfortunately, theft of such delivered packages is also becoming increasingly common. Even if the delivered package is somewhat hidden, such as behind a plant or fence, the delivered package is still subject to theft (until the person inside the home or building comes outside to secure the delivered package).

Accordingly, in the arts of package delivery to a home or building, there is a need in the arts for improved methods, apparatus, and systems for securing such delivered packages from theft.

SUMMARY OF THE INVENTION

A system for securing packages has a support pole secured proximate to a hinged side of a door; a frame secured to the support pole; a securing means secured to the door frame and to the door; and a package box that is secured to the frame and that receives a delivered package. The package box is defined by a front panel, a bottom panel rotatably secured to the front panel, a lid panel rotatably secured to the frame, and a first and second plurality of side members rotatably secured to the frame and the front panel. When the package box is in a folded position, the front panel, the bottom panel, and the lid panel are oriented vertically and are proximate to the frame. When the package box is opened, the front panel extends outwardly in a vertical orientation and the bottom panel rotates downwardly to a horizontal orientation

BRIEF DESCRIPTION OF THE DRAWINGS

The components in the drawings are not necessarily to scale relative to each other. Like reference numerals designate corresponding parts throughout the several views.

DETAILED DESCRIPTION

Figure 1:
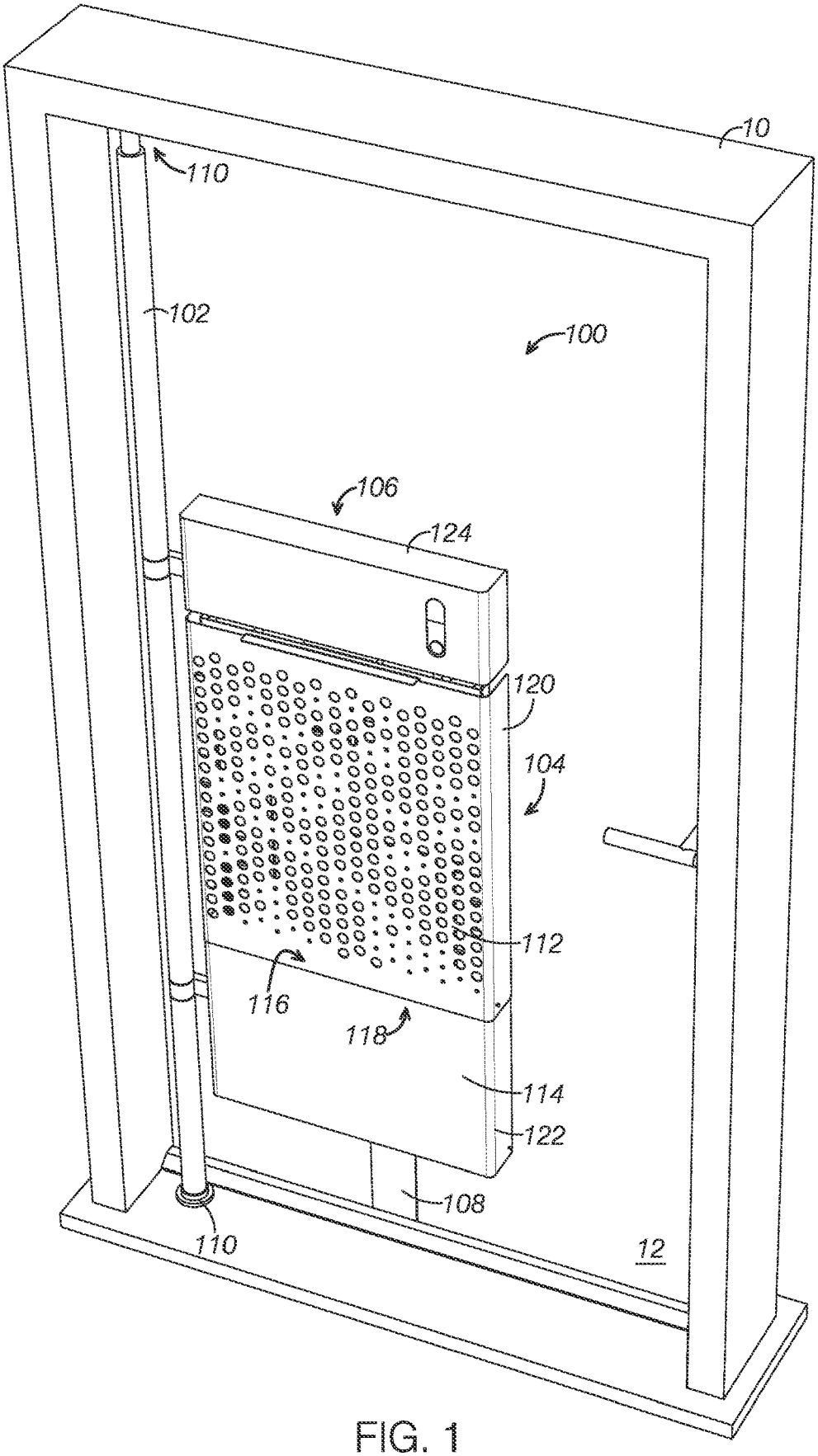
FIG. 1 is a perspective view of an example embodiment of a delivered package security system secured to a door frame and a closed door of a building.
Figure 2:
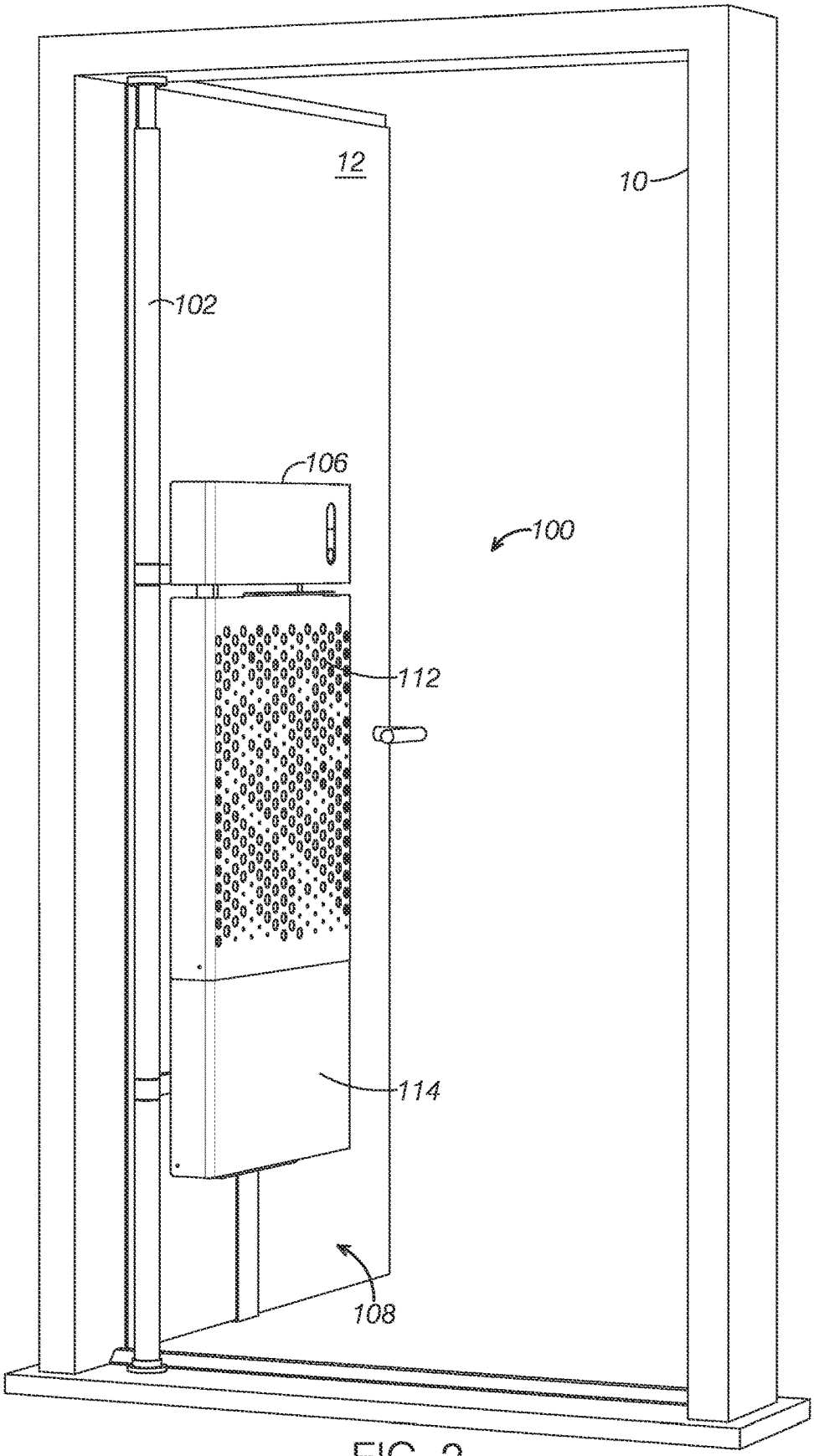
FIG. 2 is a perspective view of the example embodiment of the delivered package security system secured to the door frame and an opened door of the building.

FIG. 1 is a perspective view of an example embodiment of a delivered package security system 100 secured to a door frame 10 and a closed door 12. The door 12 is an entrance door between the outside and the interior of a building (not shown). FIG. 2 is a perspective view of the example embodiment of the delivered package security system 100 secured to the door frame 10 and the closed door 12 of the building. The delivered package security system 100 comprises a support pole 102, a package box 104, a controller system 106 (interchangeably referred to herein as a controller 106), and a securing means 108 for securing the delivered package security system 100 to the door frame 10 and/or to the door 12.

The delivered package security system 100 is located proximate to the outside surface of the door 12. In FIG. 1, the package box 104 of the delivered package security system 100 is illustrated in a folded (closed) position prior to delivery of a package. When a package is delivered, the delivery person is able to open the folded package box 104 so that a delivered package can be placed into the package box 104.

Preferably, the folded package box 104 is relatively thin. As illustrated in FIG. 2, when the door 12 is opened, a user can easily pass through the opened door 12 without bumping into the folded package box 104. For example, the owner may secure the delivered package security system 10 to the door frame 102 and the door 12 in the morning on their way to work (assuming that they are anticipating a package delivery during the day while they are at work). The owner may close and lock the door 12 before leaving for work. When they return from work, they may remove the package and close up the package box 104 into the folded position. Then, they may remove and store the delivered package security system 100. Alternatively, they may leave the delivered package security system 100 with the folded package box 104 secured to the door frame 10 and door 12.

The disclosed systems and methods for a delivered package security system 100 will become better understood through review of the following detailed description in conjunction with the figures. The detailed description and figures provide examples of the various inventions described herein. Those skilled in the art will understand that the disclosed examples may be varied, modified, and altered without departing from the scope of the inventions described herein. Many variations are contemplated for different applications and design considerations, however, for the sake of brevity, each and every contemplated variation is not individually described in the following detailed description.

Throughout the following detailed description, a variety of examples for systems and methods for a delivered package security system 100 are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components. "Secured to" means directly connected without intervening components.

"Communicatively coupled" means that an electronic device exchanges information with another electronic device, either wirelessly or with a wire based connector, whether directly or indirectly through a communication network. "Controllably coupled" means that an electronic device controls operation of another electronic device.

Returning to FIG. 1, the support pole 102 is configured to be secured to the lower portion and the upper portion of the door frame 10 proximate to the hinged side of the door 12. In some embodiments, the support pole 102 is extendable to facilitate installation and/or removal of the delivered package security system 100 when not in use. Preferably, the extended support pole 102 after installation can be locked into its extended position to prevent tampering by an unauthorized individual. Accordingly, the installed support pole 102 cannot be removed from the lower portion and the upper portion of the door frame 10.

The securing plates 110 are configured to prevent slippage of the support pole 102 after installation. Securing plates 110 may be permanently or releasably secured to the lower portion and the upper portion of the door frame 10. Here, the securing plates 110 are configured to receive and secure the ends of the extended support pole 102. In other embodiments, the securing plate 110 is part of the support pole 102.

A front panel 112 and a bottom panel 114 are vertically oriented and adjacent to each other when the package box 104 is in the folded position. In a preferred embodiment, the lower edge 116 of the bottom panel 114 is hinge coupled to the outer edge 118 of the bottom panel 114.

Optionally, the front panel 112 may include side members 120 and the bottom panel 114 may include side members 122. The side members 120, 122 improve the aesthetic appearance of the delivered package security system 100 when the package box 104 is in the folded position. Further, the side members 120, 122 strengthen the structure of the delivered package security system 100, thereby making theft of a secured package more difficult.

The controller system 106 is enclosed in a tamper resistant cover 124. When the package box 104 is in the folded position, the width and thickness of the cover 124 may the same as, or substantially the same as, the width and thickness of the front panel 112 and the bottom panel 114 to give the delivered package security system 100 a slim and aesthetically pleasing appearance. The outside surface of the front panel 112, the bottom panel 114, and the cover 124 may be painted or otherwise treated in any manner to further improve the aesthetic appearance of the delivered package security system 100. In an example embodiment, the outside surfaces of the front panel 112, the bottom panel 114, and the cover 124 are made of weather resistant brushed steel.

In a preferred embodiment, the folded package box 104 is locked (secured) and cannot be opened in the absence of authorization from the controller system 106. When a package is delivered, the arrival of the delivery person may be indicated to the controller system 106. In response to the arrival of the delivery person, the folded package box 104 is released by the controller system 106.

In some embodiments, the delivered package security system 100 includes a smart lock 602 (FIG. 6) that may be released by the owner, another authorized person, and/or the delivery person. A spring or other moving means may then push the front panel 112 outward and downward to open the package box 104.

Figure 3:
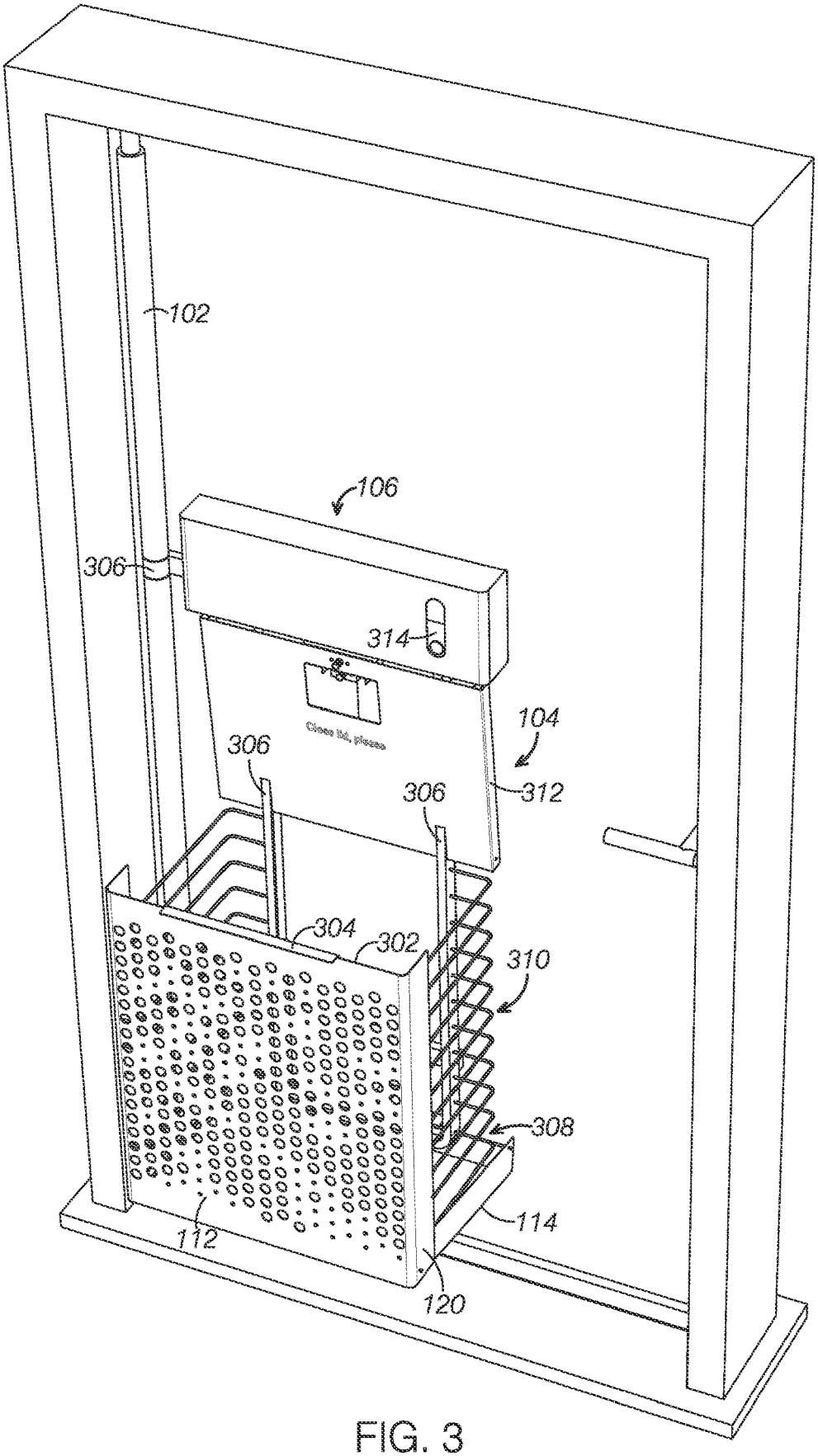
FIG. 3 is a perspective view of the example embodiment of the delivered package security system with an opened package box.

FIG. 3 is a perspective view of the example embodiment of the delivered package security system 100 with an opened package box 104. After the controller system 106 has released the folded package box 104, the delivery person may then open the package box 104 into the opened position. Here, the delivery person grasps the top edge 302 of the front panel 112 and pulls the front panel 112 downward and outward. As the front panel 112 moves outward and downward (remaining in a horizontal orientation), the hinged bottom panel 114 rotates downward into a horizontal orientation. The top edge 302 may optionally include a handle 304 or the like for the delivery person to grasp.

A frame 306 is rigidly secured to the support pole 102 and the securing means 108 (FIG. 1). The controller system 106 is also preferably rigidly secured to the frame 306. The frame 306 is also rotatably secured to the support pole 102. Alternatively, or additionally, the support pole 102 may be rotatable along is longitudinal axis. Since the support pole 102 cannot be removed from the door frame 10, and the securing means 108 cannot be removed from the door 12, the frame 306 secures the package box 104 so that a potential thief cannot access and/or remove the delivered package.

The inner edge 308 of the bottom panel 114 is rotatably hinged to the bottom portion of the frame 306. As the bottom panel 114 moves downward into a horizontal orientation or substantially horizontal orientation, the hinged inner edge allows rotation of the bottom panel 114 while keeping the bottom panel 114 secured to the frame 306.

When in the opened position, a plurality of horizontally aligned side members 310 form the left and right sides of the opened package box 104. In a non-limiting example embodiment, the proximal ends of the side members 310 are rotatably secured to the frame 306. The distal ends of the side members 310 are rotatably secured to the side edges of the front panel 112. Accordingly, when the package box 104 is closed and in its folded position, the side members 310 are substantially vertically oriented. Preferably, the side members 310 are hidden from view by the sides 120 of the front panel 112 when the package box 104 is closed.

During opening of the package box 104, as the front panel 112 moves outward and downward into its vertical orientation, the hinged side members 310 rotate downwardly from their substantially vertical orientation. When the package box 104 has been opened, the side members 310 are then in a substantially horizontal orientation.

Preferably, the side members 310 are made of a rigid material that is tamper resistant. In a preferred embodiment, the side members 310 may be strengthened steel wires or bars. Other embodiments may employ flexible chains, steel cables or the like as the side members 310.

When the package box 104 is initially opened by the delivery person, the lid 312 is oriented in a vertical orientation behind the front panel 112. When the package box 104 is in its closed and folded position, the vertically oriented front panel 112 hides the lid 312 from view. Preferably, the lid 312 is made of a rigid, tamper proof material, such as a steel plate or the like.

In an example embodiment, a controller device 314 resides on the exterior surface of the controller system 106. The delivery person may actuate the controller device 314 to unlock the folded package box 104. Any suitable controller device 314 may be used in the various embodiments, such as a push button, a switch, or a key pad. If a keypad is used, the delivery person may enter a password to unlock the folded package box 104. In response to receiving a predefined pattern of actuation of the plurality of uniquely identified actuators by the delivery person, the folded package box 104 is released for unfolding.

Alternatively, or additionally, the folded package box 104 may be unlocked in a variety of other manners. In a preferred embodiment, an optional smart lock 602 (FIG. 6) is located on the upper interior surface of the front panel 112. As described in greater detail hereinbelow, the smart lock 602 locks the package box 104 in its folded up position. The smart lock 602 releases when an unlock command is received.

Alternatively, or additionally, an example embodiment may include an image capture device 314. Upon approach by the delivery person, the controller system 106 transmits the image to a remote electronic device, such as a smartphone of the owner or other authorized person. Once the owner or other authorized person verifies the authenticity of the delivery person, the owner or other authorized person can then send an unlock command from their remote device back to the controller system 106 and/or the smart lock 602 to unlock the package box 104.

Alternatively, or additionally, a scanner 314 may be configured to scan a bar code, QR code, or the like, that is printed on an identification badge or card carried by the delivery person. Alternatively, or additionally, the code may be printed on the package label or the package itself. On arrival, the delivery person scans the code using the scanner 314. Once the code has been verified, the package box 104 is unlocked. The verification of the code (and therefore verification of the delivery person and/or package) may be done locally by the controller system 106 or remotely using another remote electronic device.

Alternatively, or additionally, a microphone 314 may detect words spoken by the delivery person. In one such embodiment, the delivery person may speak a predefined security code that would unlock the package box 104. Alternatively, the controller system 106 transmits the voice information to a remote electronic device, such as a smartphone of the owner or other authorized person. Once the owner or other authorized person verifies the authenticity of the delivery person, the owner or other authorized person can then send an unlock command that is received by the smart lock 602 from their remote device back to the controller system 106. Such an embodiment may be used with the above-described camera 314. A speaker 314 may be included to support a real time, two-way voice conversation between the delivery person and the owner or other authorized person.

Alternatively, or additionally, the controller system 106 may employ a radio frequency identifier (RFID) scanner that is configures to sense an RFID emitter in possession of the delivery person and/or secured to the package. When the RFID scanner detects presence of the RIFD tag, the package box 104 is unlocked.

Figure 4:
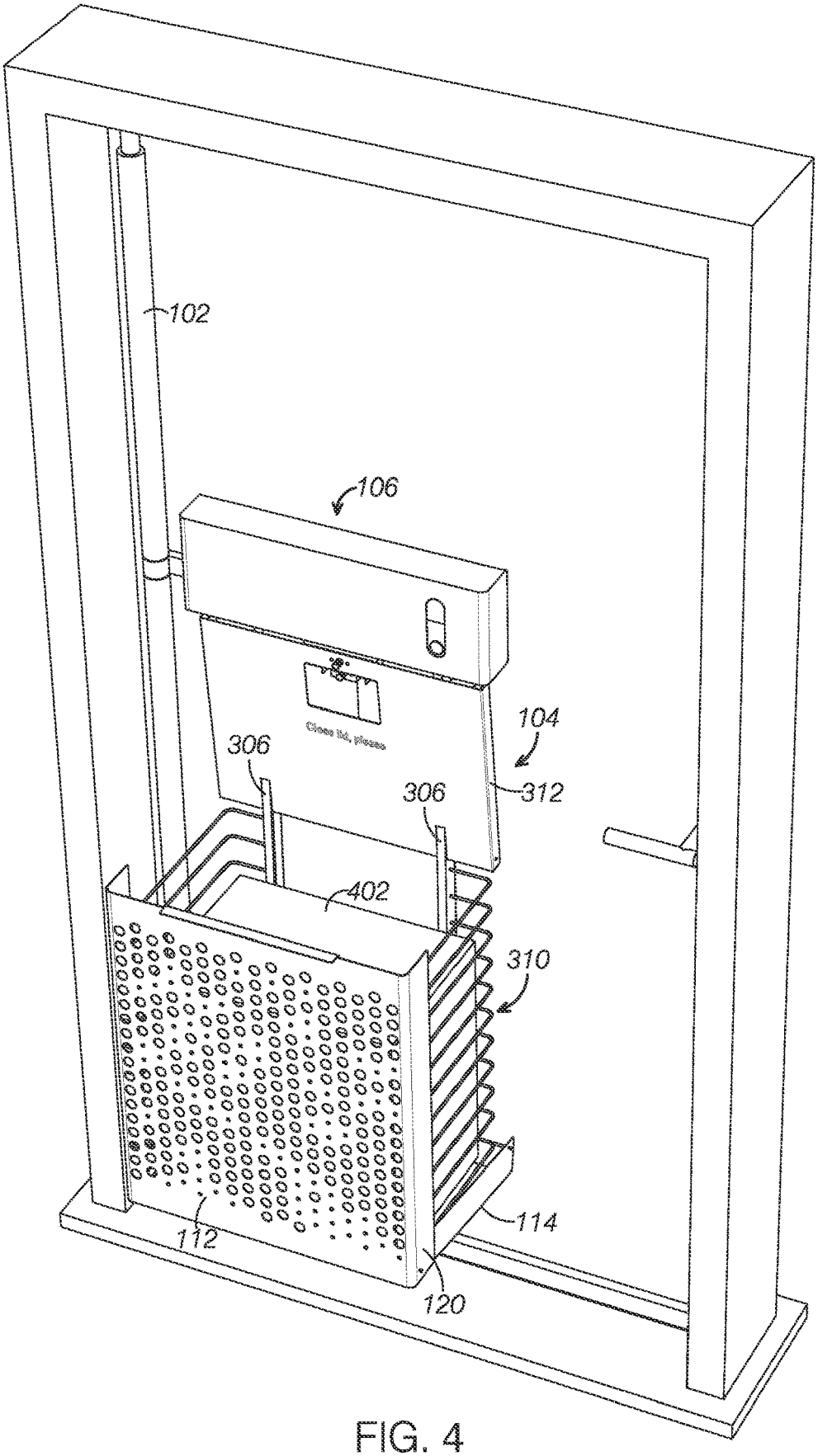
FIG. 4 illustrates a package that has been placed into the interior of the package box.

FIG. 4 illustrates a package 402 that has been placed into the interior of the package box 104. One skilled in the art appreciates that embodiments of the delivered package security system 100 may be configured to accommodate any size and/or dimension of a delivered package. That is, the interior of the opened package box 104 may have a size and dimension that is sufficient to receive any expected largest package.

Figure 5:
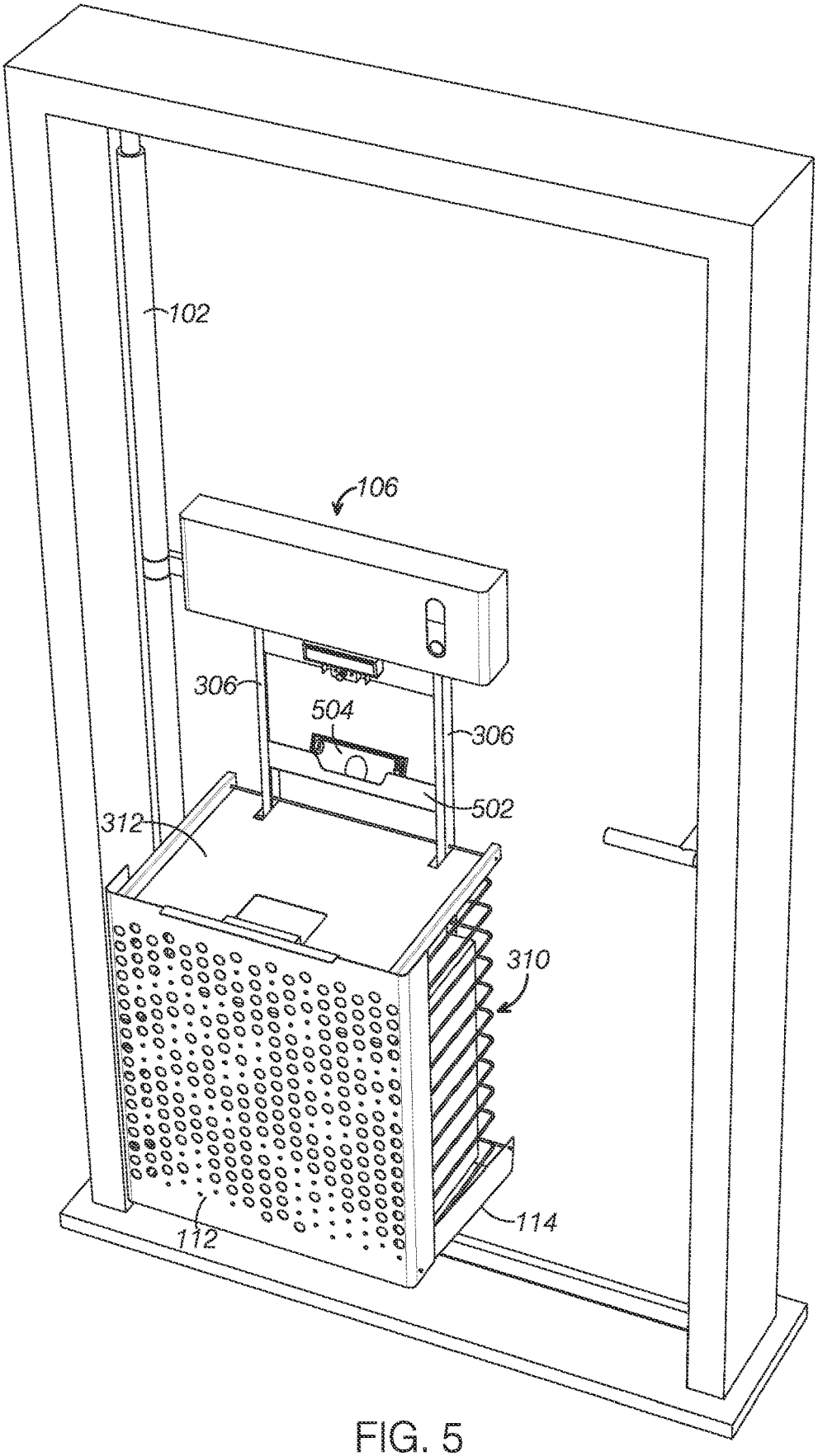
FIG. 5 illustrates a closed lid of the delivered package security system that secures the package within the interior of the package box.

Once the package box 104 has been opened, the delivery person places the package into the interior of the opened package box 104. Then, the lid 312 may be closed by the delivery person, as illustrated in FIG. 5.

In a preferred embodiment, an optional smart lock 602 (FIG. 6) is located on the upper interior surface of the front panel 112. Once the lid 312 has been closed, the smart lock 602 automatically locks the lid 312 into place so that the interior of the package box 104 cannot be accessed. When the owner or other authorized person is proximate to the closed and locked package box 104, the locked lid 312 may be released. The lid 312 may then be rotated upwardly into a vertical orientation, and the owner or other authorized person may access the package.

Some embodiments may include an optional tip tray 502 secured behind the vertically oriented lid 312. When the package has been placed into the package box 104 and the lid 312 has been closed to safely secure the delivered package, the tip tray 502 is exposed. A monetary tip, gift card, or the like left in the tip tray 502 may then be taken by the delivery person.

Figure 6:
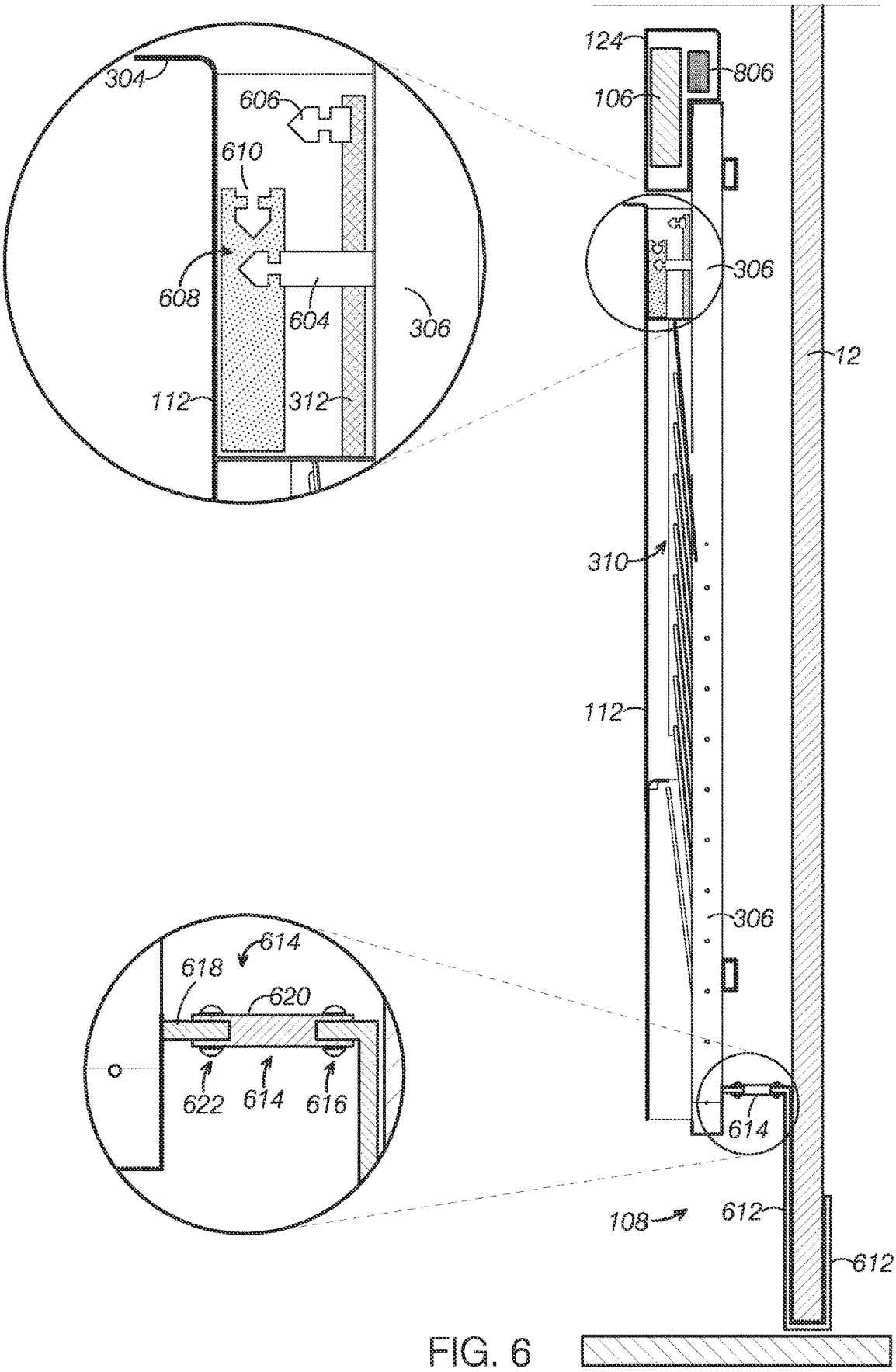
FIG. 6 is a side view, cross section of the delivered package security system with a folded package box.

FIG. 6 is a side view, cross section of the delivered package security system 100 with a folded package box 104. FIG. 6 conceptually illustrates an exemplary smart lock 602. The smart lock 602 has a frame latch 818 (FIG. 8) that is configured to engage and lock a first pin 604. A proximal end of the first pin 604 is secured to the frame 306. The first pin 604 extends through a hole in the lid 312 so that the distal end of the first pin 604 extends outwardly from the lid 313. The frame latch 818 of the smart lock 602 has a first locking aperture 608 that is configured to receive the notched distal end of the first pin 604. When the package box 104 is in the folded position, the first pin 604 enters into the first locking aperture 608. The smart lock 602 then operates a lock mechanism in the frame latch 818 that locks the first pin 604 so that the first pin 604 cannot be disengaged (withdrawn) from the first locking aperture 608.

In response to receiving a first unlocking command, the smart lock 602 releases the frame latch 818 so that the first pin 604 can be drawn out from the first locking aperture 608. Accordingly, the delivery person may pull the front panel 112 outwardly and downwardly to open the package box 104.

Figure 7:
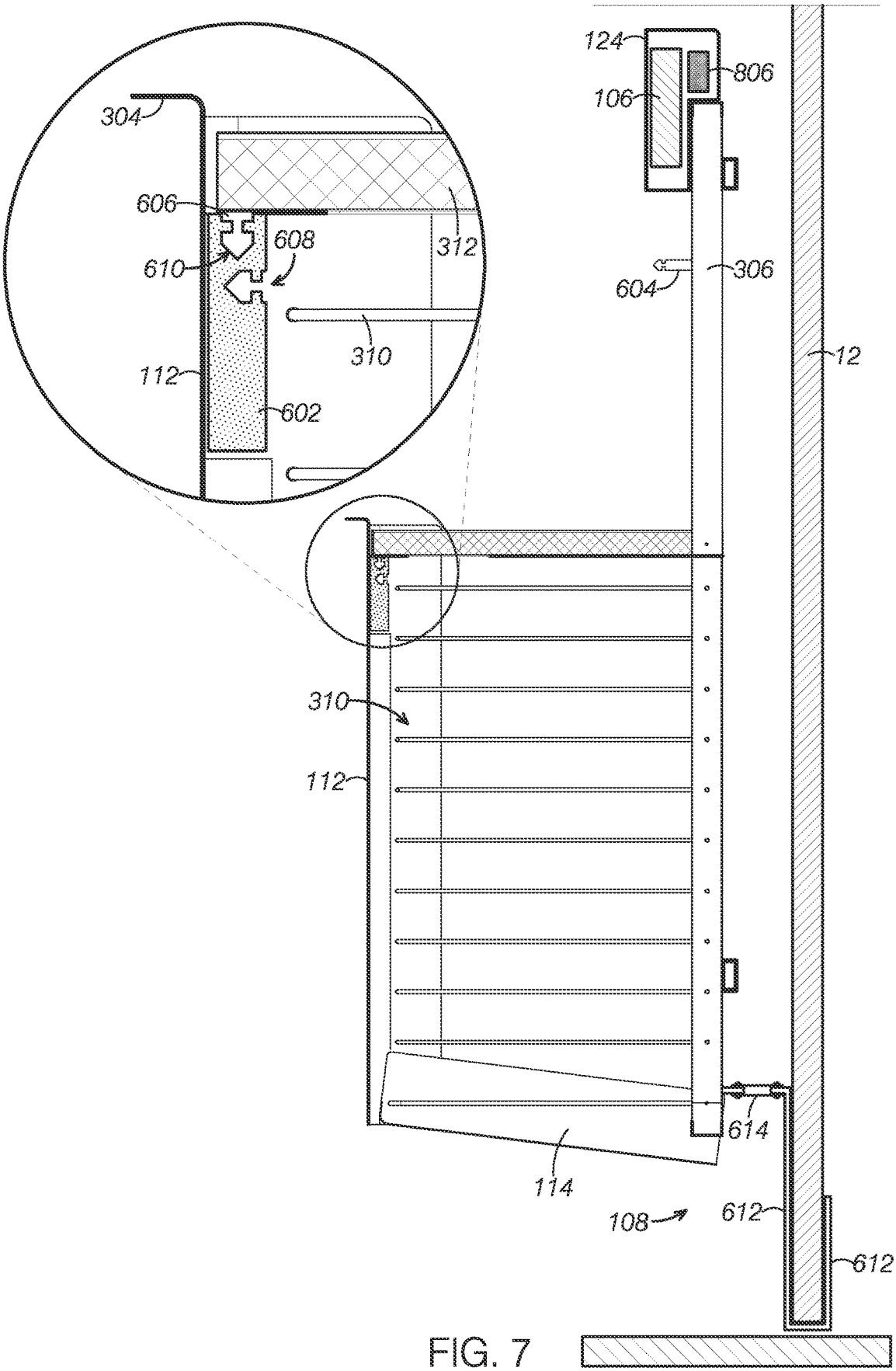
FIG. 7 is a side view, cross section of the delivered package security system with an opened package box that has been closed with the lid.

FIG. 7 is a side view, cross section of the delivered package security system 100 with an opened package box 104 that has been closed with the lid 312. A proximal end of a second pin 606 is secured to the lid 312. The second pin 606 extends outwardly from the lid 313. The smart lock 602 has a lid latch 820 (FIG. 8) with a second locking aperture 610 that is configured to receive the notched distal end of the first pin 604 when the lid 312 is oriented in a horizontal position to close the package box 104. When the lid 312 is lowered into the horizontal position, the second pin 606 enters into the second locking aperture 610. The smart lock 602 then operates a lock mechanism in the lid latch 820 that locks the second pin 606 so that the second pin 606 cannot be disengaged from the second locking aperture 610. In response to receiving a second unlocking command, the smart lock 602 releases the lid latch 820 so that the second pin 606 can be drawn out from the second locking aperture 610. Accordingly, the owner or other authorized person may lift the lid 312 upwardly to access the delivered package in the package box 104.

Any suitable alternative locking system to retain the package box 104 in the folded position and to secure the lid 312 in a closed position may be used in the various embodiments. For example, but not limited to, retractable hooks, magnets, latches or the like may be used to secure the package box 104 in a tamper proof manner when the package box 104 is in the closed position as illustrated in FIG. 6. Some embodiments may employ a legacy key and lock system. A key in possession of the owner or other authorized person may be used to unlock the lid 312. Optionally, a key (in possession of the delivery person) and lock may be used to unlock the package box 104 from the folded position. Some embodiments may omit a locking device. All such embodiments are intended to be included within this disclosure and to be protected by the following claims.

FIGS. 6 and 7 further illustrate a side view, cross section of the controller system 106. The controller system 106 resides within the tamper proof cover 124. A power supply 806 (FIG. 8) also resides within the cover 124.

In the example embodiment illustrated in FIGS. 6 and 7, the securing means 108 is formed using a rigid, tamper proof material, such as steel or the like. This example securing means 108 is formed using a "J" shaped portion 612 and a connecting member 614.

The "J" shaped portion 612 of the securing means 104 is configured to engage the outside surface and the inside surface of the door 12 at the lower end of the door 12. During installation of the delivered package security system 100, the "J" shaped portion 612 may be slid into place around the lower edge of the door 12 when the door 12 is opened. When the door 12 is closed, the "J" shaped portion 612 may not be removed from the door 12 by an unauthorized person. Other securing means may be used to secure the frame 306 to the door 12, such as bolts, screws, clamps, hooks, magnets, or other objects.

The connecting member 614 has a first connecting portion 616 rotatably coupled to the frame 306 and an opposing second connection portion 618 rotatably coupled to the "J" shaped portion 612. A bar member 620 is rotatably coupled to the first and second connecting portions 616, 618. The bar member 620 may be rotatably coupled to the first and second connecting portions 616, 618 using a connector 622, such as a rod, pin, rivet, bolt/nut, clamp screw or the like. As described in greater detail herein below, the bar member 620 facilitates opening and closing of the door 12 while the delivered package security system 100 is secured to the door frame 10 and the door 12.

Figure 8:
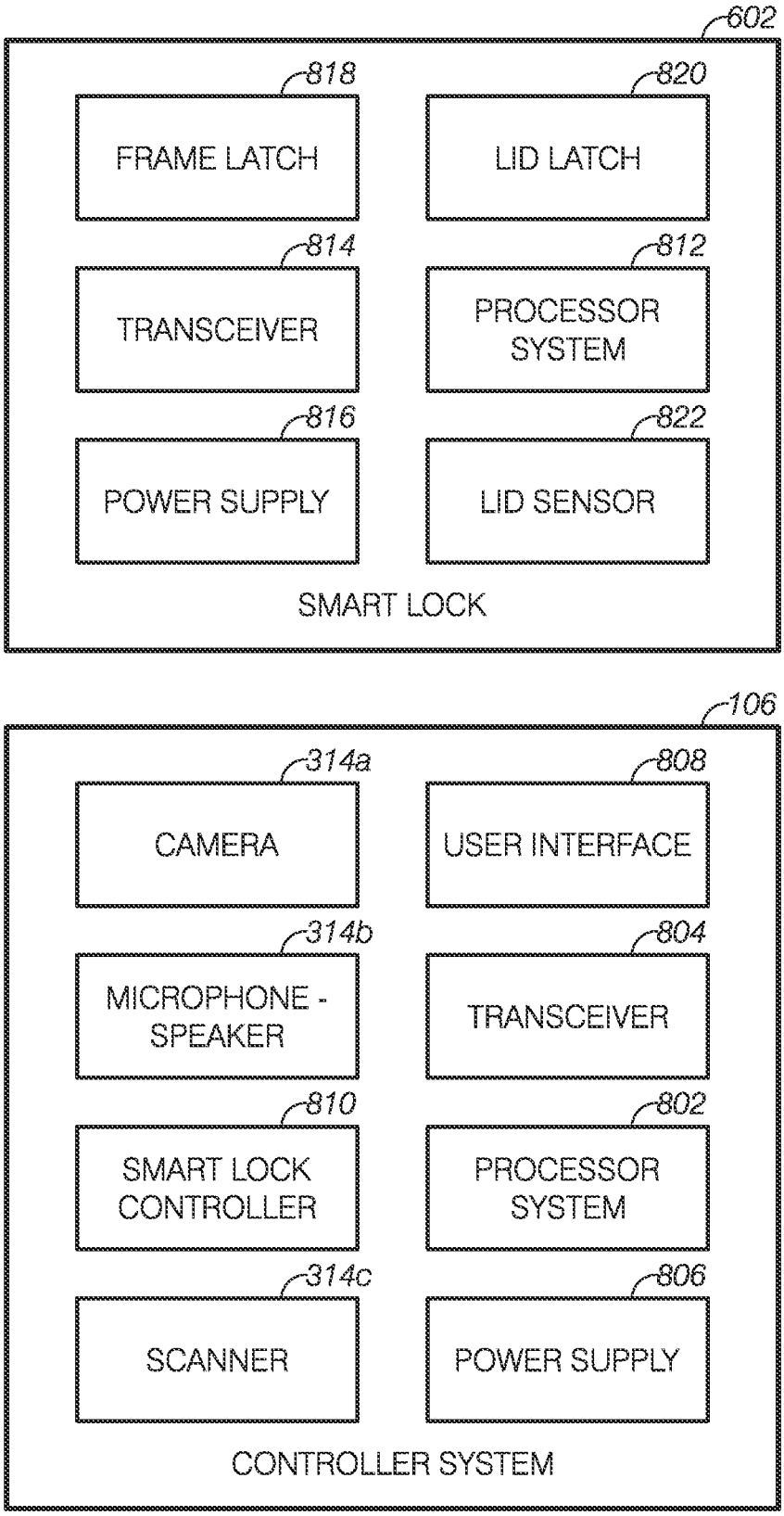
FIG. 8 is a block diagram illustrating selected electronic components of the controller system and the smart lock.

FIG. 8 is a block diagram illustrating selected electronic components of the controller system 106 and the smart lock 602. The non-limiting exemplary controller system 106 comprises a processor system 802, a transceiver 804, power supply 806, an optional user interface 808, a smart lock controller 810, an optional camera 314*a*, an optional microphone-speaker 314*b* and/or an optional scanner 314*c*. The non-limiting exemplary smart lock 602 comprises a processor system 812, a transceiver 814, power supply 816, a frame latch 818, a lid latch 820, and/or an optional lid sensor 822. Other delivered package security systems 100 may include some, or may omit some, of the above-described electronic components. Further, additional components not described herein may be included in alternative embodiments.

The processor systems 802, 812 include one or more microprocessors and memories to control operation of the controller system 106 and the smart lock 602, respectively. Any processor system now known or later developed are intended to be within the scope of this disclosure and to be protected by the accompanying claims.

The transceiver 804 is configured to be communicatively coupled to a remote electronic device of the owner or other authorized person. Examples of the remote electronic device include a smartphone, a personal computer, a lap top computer, a note book, a personal device assistant (PDA) or the like. The owner or other authorized person can use the remote electronic device to generate lock commands and/or unlock commands (release commands0 that are transmitted to the transceiver 802 via a suitable communication system (not shown) using wireless or wire-based signals.

The transceiver 814 is communicatively coupled to the transceiver 804 in a preferred embodiment. In such embodiments, the transceiver 814 may employ a low power communication system, such as a near-field communication system. An example near-field communication is Bluetooth. Any suitable low power and/or near-field communication system now known or later developed may be used in the various embodiments. A low power near-field communication system is suitable because of the close proximity of the controller system 106 and the smart lock 602 to each other.

When the remote electronic device is a smart phone, the communication system is a cellular telephone system, such as a radio frequency (RF) wireless system. Here, the owner or other authorized person may use their smartphone or other portable electronic device to communicate with the controller system 106 and/or the smart lock 602 via the transceiver 802, 814.

Alternatively, the communication system may be a telephony system, the Internet, a Wi-fi system, Bluetooth, a near-field communication system, a microwave communication system, a fiber optics system, an intranet system, a local access network (LAN) system, an Ethernet system, a cable system, an infrared system, a satellite system, or a hybrid system comprised of multiple types of communication media. Additionally, embodiments may be implemented to communicate using other types of communication technologies, such as but not limited to, digital subscriber loop (DSL), X.25, Internet Protocol (IP), Ethernet, Integrated Services Digital Network (ISDN) and asynchronous transfer mode (ATM), and 4G/5G wireless networks. Also, embodiments of the transceivers 804, 814 may be configured to communicate over combination systems having a plurality of segments which employ different formats for each segment that employ different technologies on each segment. Any transceiver now known or later developed is intended to be within the scope of this disclosure and to be protected by the accompanying claims.

In practice, with the preferred embodiment illustrated in FIGS. 6 and 7, the package box 104 is initially in the folded (closed) position as illustrated in FIGS. 1 and 6. The delivery person, upon arrival, must first open up the package box 104. When a first unlock command is received by the transceiver 804 from some source, the transceiver 804 communicates a second unlock command to the transceiver 812 of the smart lock 602. In response to receiving the second unlock command, the processor system 812 actuates the frame latch 818 to release the first pin 604 (FIG. 6). Then, the delivery person may move the front panel 112 outwardly and downwardly to open the package box 104.

After the delivery person has placed the package in the opened package box 104, the delivery person then closes the lid 312. In an example embodiment, the optional lid sensor 822 senses the covering of the package box 104 by the lid 312. The processor system 812 actuates the lid latch 820 to lock the lid. Here, the second pin 606 is locked into the second locking aperture 610.

When the owner or other authorized person arrives at the delivered package security system 100, the owner or other authorized person uses their remote device to communicate a lid release signal that is communicated to the controller system 106 and/or the smart lock 602. The lid latch 820 releases in response to receiving the lid release command such that the second pin 606 can be pulled out from the second locking aperture 610 as the lid 312 is opened by the owner or other authorized person.

Alternatively, or additionally, the owner or other authorized person may input instructions via the user interface 808 to unlock the lid 312. For example, if the user interface 808 is a key pad, then a security code could be manually entered to unlock the lid 312.

Alternatively, or additionally, a legacy key and lock device may be used to unlock the lid 312. The keyed lock may, in an example embodiment, be accessed on the surface of the lid 312, on the surface of the front panel 112, or on the surface of the cover 124 of the controller system 106.

Power is supplied to the various components of the controller system 106 and the smart lock 602 by a power supply 806, 816, respectively. An example embodiment employs one or more batteries as the power supply 806, 816. Alternatively, or additionally, the power supply 806, 816 may be a solar powered photovoltaic device. Alternatively, or additionally, the power supply 806, 816 may be connected to the electrical system of the building that is connected to a power grid.

One skilled in the art appreciates that, in the alternative, the owner (or other authorized person) may leave a package for pickup by a delivery person or another authorized person. The owner of the delivered package security system 100 simply opens the package box 104, places their package inside the package box 104, and then closes and locks the lid 312 as described herein. When the delivery person or other authorized person arrives, they release the locked lid 312 as described herein. For example, if the user interface 808 is a key pad, the delivery person or other authorized person enters a predefined code using the user interface 808 to unlock the lid 312. Alternatively, or additionally, the delivery person or other authorized person may get into contact with the owner using their mobile device. After verification of the identity of the delivery person or other authorized person, the owner then issues an unlock command to the smart lock 602. Once the lid 312 has been unlocked, the delivery person or other authorized person can remove the package that is being picked up.

Figure 9:
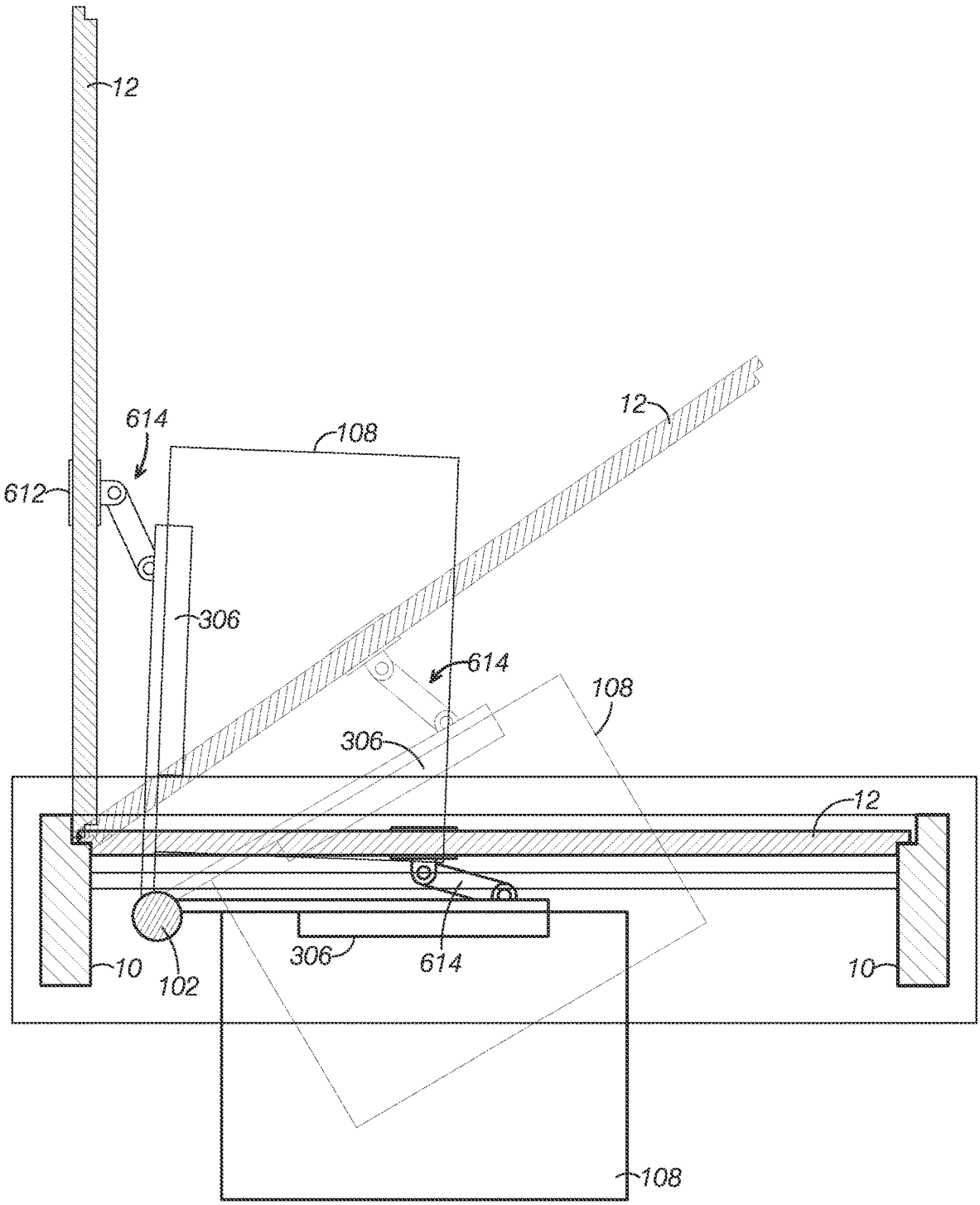
FIG. 9 conceptually illustrates the opening of the door while the delivered package security system is secured to the door frame and the door.

FIG. 9 conceptually illustrates the opening of the door 12 while the delivered package security system 100 is secured to the door frame 10 and the door 12. Here, the connecting member 614 facilitates the opening and closing of the door 12 without substantial movement of the "J" shaped portion 612.

Alternative embodiments of the delivered package security system 100 may use other types of securing means 108 to secure the package box 104. For example, but not limited to, the frame 306 may be secured to the support pole 102 only. A torsional spring fixed to the support pole 102 may allow the support pole 102 to pivot as the door 12 is opened or closed. Once the door 12 is closed, the torsional spring is energized or released to push the package box 104 into position in from of the door 12. When the door 12 is opened, the package box 104 follows the opening door and deenergizes the torsional spring.

An alternative embodiment omits the support pole 102. Rather, the "J" shaped portion 612 is sued to secure the package box 104 directly to the door 12. In such an embodiment, the inside of the "J" shaped portion 612 may be secured to the inside surface of the door 12 using a suitable fastener. Suitable fasteners include screws, bolts, magnets, and releasable plates (with rotatable screws).

It should be emphasized that the above-described embodiments of the delivered package security system 100 are merely possible examples of implementations of the invention. Many variations and modifications may be made to the above-described embodiments. All such modifications and variations are intended to be included herein within the scope of this disclosure and protected by the following claims.

Furthermore, the disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower, or equal in scope to the original claims, are to be considered within the subject matter of the inventions described herein.

Therefore, having thus described the invention, at least the following is claimed:

1. A delivered package security system releasably secured to an outside of a door and to a door frame, comprising:

a support pole configured to be secured proximate to a hinged side of the door frame;

a frame secured to the support pole;

a securing means securing the delivered package security system to the frame and to the door; and a package box secured to the frame, wherein the package box is configured to receive a package, the package box comprising:

a front panel defined by an inside surface, an outside surface, a left side edge, a right side edge, a top edge and a bottom edge;

a bottom panel defined by an inside surface, an outside surface, an outside edge and an inside edge, wherein the outside edge of the bottom panel is rotatably secured to the bottom edge of the front panel, and wherein the inside edge of the bottom panel is rotatably secured to the frame;

a lid panel defined by an upper surface, a lower surface, an outside edge and an inside edge, wherein the inside edge of the lid panel is rotatably secured to the frame;

a first plurality of side members with a proximal end rotatably secured to the frame and with a distal end rotatably secured to the left side edge of the front panel; and a second plurality of side members with a proximal end rotatably secured to the frame and with a distal end rotatably secured to the right side edge of the front panel, wherein in response to closing the package box into a folded position, the front panel, the bottom panel, and the lid panel are oriented vertically and are proximate to the frame, wherein in response to opening the package box, the front panel extends outwardly in a vertical orientation and the bottom panel rotates downwardly to a horizontal orientation, and wherein the vertically oriented front panel, the horizontally oriented bottom panel, the first plurality of side members, the second plurality of side members and the frame cooperatively define the package box that is configured to receive the package.

2. The delivered package security system of claim 1, wherein the securing means comprises:

a "J" shaped portion configured to be releasably secured to the lower edge of the door, and a connecting member with a first connecting portion that is rotatably coupled to the "J" shaped portion and a second connecting portion that is rotatably coupled to the frame.

3. The delivered package security system of claim 1, further comprising:

a lid latch located on the inside surface of the front panel and proximate to the top edge of the front panel, wherein in response to rotating the lid panel downward so that the outside edge of the lid panel is proximate to the top edge of the front panel, the lid latch actuates to securely couple the lid panel to the front panel, and wherein a thief or unauthorized person cannot actuate the lid latch to release the lid panel from the front panel to access the package from the package box.

4. The delivered package security system of claim 3, further comprising:

a tip tray secured to the frame, wherein the tip tray is configured to enclose a tip, wherein the tip tray is covered by the lid panel while the package box is closed in the folded position, wherein the tip tray and the lid panel are covered by the front panel while the package box is closed in the folded position, and wherein the tip tray is accessible after the lid panel has been rotated downward so that lid panel is secured to front panel by the lid latch.

5. The delivered package security system of claim 3, further comprising:

a frame latch located on the inside surface of the front panel and proximate to the top edge of the front panel;

a first pin secured to the frame; and a second pin secured proximate to the outside edge of the lid, wherein in response to closing the package box into the folded position, the frame latch actuates to engage the first pin to lock the package box in the folded position, and wherein in response to rotating the lid panel downward so that the lid panel is proximate to the top edge of the front panel, the lid latch actuates to engage the second pin to secure the lid panel to the front panel.

6. The delivered package security system of claim 5, further comprising:

a smart lock processor system controllably coupled to the frame latch and the lid latch, wherein the smart lock processor system is operable to communicate a first signal to the frame latch that causes the frame latch to release from the first pin, wherein the smart lock processor system is operable to communicate a second signal to the lid latch that causes the lid latch to release from the second pin, wherein the frame latch releases from first pin to release the package box from the folded position such that the package box opens to receive the package, and wherein the lid latch releases from second pin to release the lid panel from the front panel such that the package is removeable from the package box.

7. The delivered package security system of claim 6, further comprising:

a controller comprising a processor system; and a user interface communicatively coupled to the controller, wherein the controller processor system communicates the first signal to the frame latch in response to receiving a first authorization signal initiated by a delivery person via the user interface, and wherein the controller processor system communicates the second signal to the lid latch in response to receiving a second authorization signal initiated by a user who is authorized to receive the package.

8. The delivered package security system of claim 7, wherein the user interface comprises:

a scanner that is configured to scan a bar code, and wherein the scanner communicates the first authorization signal to the controller processor system in response to scanning the bar code that is on one of the package or a card in possession by the delivery person.

9. The delivered package security system of claim 7, wherein the user interface comprises:

a transceiver that receives a signal from a smart phone possessed by the user, and wherein the transceiver communicates the second authorization signal to the controller processor system in response to receiving the signal from the smart phone.

10. The delivered package security system of claim 7, wherein the user interface comprises:

a key pad communicatively coupled to the controller processor system, wherein the keypad includes a plurality of uniquely identified actuators, and wherein the key pad communicates security code information to controller processor system to generate the second authorization signal in response to receiving a predefined pattern of actuation of the plurality of uniquely identified actuators.

11. The delivered package security system of claim 1, wherein the support pole is configured to be secured between an upper surface and a lower surface of an outside portion of the door frame.

12. The delivered package security system of claim 11, wherein the support pole is secured to the door frame, and wherein the frame is rotatably secured to the support pole so that the frame rotates with the door as the door is opened.

13. The delivered package security system of claim 11, wherein the support pole is rotatably secured to the door frame, and wherein the frame is secured to the support pole so that the support pole rotates when the door is opened.

14. The delivered package security system of claim 1, wherein in response to closing the package box, the first plurality of side members and the second plurality of side members are oriented substantially vertically, and wherein in response to opening the package box, the first plurality of side members and the second plurality of side members are oriented substantially horizontally.

* * * * *